US007213939B2

(12) United States Patent
Van Brocklin et al.

(10) Patent No.: US 7,213,939 B2
(45) Date of Patent: May 8, 2007

(54) HUE ADJUSTING LIGHTING SYSTEM

(75) Inventors: Andrew L. Van Brocklin, Corvallis, OR (US); Daryl E. Anderson, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 30 days.

(21) Appl. No.: 10/792,259

(22) Filed: Mar. 2, 2004

(65) Prior Publication Data

US 2005/0195596 A1 Sep. 8, 2005

(51) Int. Cl.
*F21V 9/00* (2006.01)

(52) U.S. Cl. ..... 362/231; 362/2; 362/16; 362/26; 362/601

(58) Field of Classification Search ..... 362/231, 362/26, 27, 601, 368, 301, 2, 16, 140, 276, 362/283, 642; 359/238, 239, 298
See application file for complete search history.

(56) References Cited

U.S. PATENT DOCUMENTS 3,968,355 A * 7/1976 Smallegan ..... 362/642
4,953,011 A * 8/1990 Mori et al. ..... 348/30
4,992,704 A 2/1991 Stinson
5,075,823 A 12/1991 Chomyn
5,303,037 A 4/1994 Taranowski
5,447,436 A 9/1995 Campagnuolo et al.
5,803,579 A 9/1998 Turnbull et al.
5,961,201 A 10/1999 Gismondi
6,123,436 A 9/2000 Hough et al.
6,527,977 B2 3/2003 Helber et al.
6,554,439 B1 4/2003 Teicher et al.
6,590,149 B2 7/2003 Adelhelm
6,663,262 B2 12/2003 Boyd et al.
6,819,466 B2 * 11/2004 Tayebati ..... 359/260
2003/0123119 A1 7/2003 Morozov et al.
2003/0146370 A1 8/2003 Ralph et al.
2003/0210221 A1 * 11/2003 Aleksic ..... 345/102
2004/0052076 A1 * 3/2004 Mueller et al. ..... 362/293

* cited by examiner

*Primary Examiner*—Sandra O'Shea
*Assistant Examiner*—Mark Tsidulko

(57) ABSTRACT

This disclosure describes a lighting apparatus comprising a light hue modulating device that generates compensating light to adjust the light to a desired hue within a space regardless of the hue of the ambient light within the room.

28 Claims, 4 Drawing Sheets

HUE ADJUSTING LIGHTING SYSTEM

BACKGROUND

The invention generally pertains to lighting systems. Conventional lighting systems include lights that are switched between an on state in which a consistent color of light is projected, and an off state in which no light is projected depending on the desired lighting conditions. Halogen lights, incandescent lights, and/or fluorescent lights are often used in these lighting systems. These conventional lighting systems provide a substantially constant color or hue when in the on state. As the ambient light in the room varies, so will the combined hue of the ambient light combined with the light from the conventional lighting systems.

It would be desirable to provide a lighting system that provides a more desirable hue of illumination.

BRIEF DESCRIPTION OF THE DRAWINGS

Illustrative and presently preferred embodiments of the invention are shown in the drawings, in which.

The same numbers are used throughout the document to reference like components and/or features.

DETAILED DESCRIPTION

This disclosure describes a number of embodiments of a hue adjusting lighting system that adjusts the hue (synonymous with color in this disclosure) of produced light to provide a substantially constant lighting hue within a room. The hue adjustment of the light within the room is performed using a light hue modulating device such as a Fabry-Perot interferometer device whose operation is generally well known, and whose structure includes two plates that are spaced a controllable distance from each other depending upon the wavelengths of light that are desired to be transmitted and those wavelengths of light that are to be reflected. The light hue modulating device generates those hues that are desired to provide the total desired hue within the room. Hues of light within rooms typically change as the hues of the ambient light within the room change. For instance, the hue contributed from the ambient light from the sun changes as the sun changes position between midday where there are more blue hues in the ambient light, and sunset where there are more red hues in the ambient light.

This disclosure provides a number of mechanisms by which the hue of the room is maintained at a desired hue based on the light that is applied from the hue adjusting lighting system as the ambient lighting coming in to the room changes (due to the color of the light supplied by the sun and/or other outdoor conditions). The total hue of the light in the room includes the ambient light (which could include the sun and/or other lights than the hue adjusting lighting system within or out of the room) plus whichever hue adjusting light that is supplied by the hue adjusting lighting system. The hue of the total light within the room (including the hue of the light from the hue adjusting lighting system plus the hue of the ambient light) are at a more constant hue throughout the day because the hue adjusting light compensates for hue variations in the ambient light. In some embodiments, the color of this more constant hue is selected by a user to provide a desired room hue color.

While the hue adjusting lighting system is described as being applied to a room in certain embodiments, the hue adjusting lighting system is applicable to any space in which it is desired to control the hue of light. For example, the hue adjusting lighting system 100 as described with respect to FIGS. 1 and 5 can be applied to a sports complex, auditoriums, outside regions, and the like where lighting would be desired to compensate for variations in the ambient light.

Figure 1:
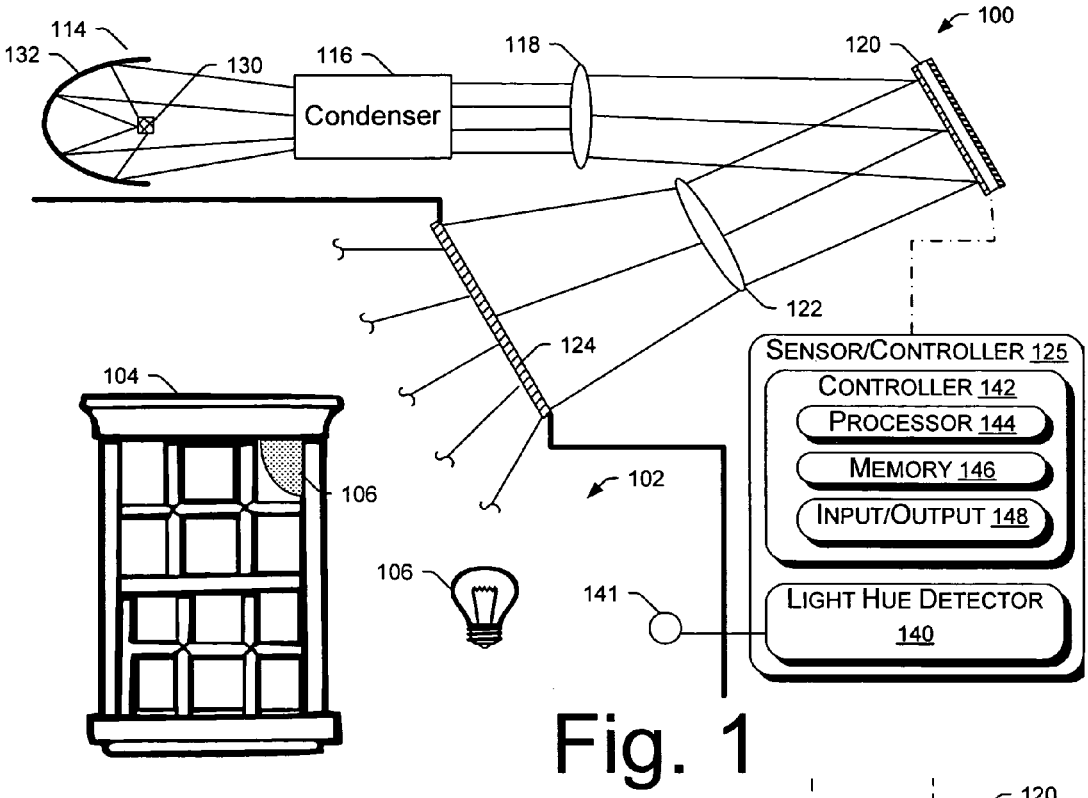
FIG. 1 is a block diagram of one embodiment of a hue adjusting lighting system of the present disclosure that includes a front-lit light hue modulating device.

FIG. 1 shows a schematic diagram of one embodiment of the hue adjusting lighting system 100 as disclosed in the present disclosure in which the hue of the light in the room is adjusted to some desired hue as selected by the user regardless of the hue of the ambient light. The hue adjusting lighting system 100 is located relative to a room 102 that contains one or more ambient light sources 106 such as a window 104, a door, or a light (e.g., an incandescent or a fluorescent light bulb). Ambient light can be applied via a window from such a source as the sun. The ambient light sources 106 are contained within, or located outside of, the room 102. The hue adjusting lighting system 100 allows a substantially constant (e.g., at a desired and controllable color) light hue to be maintained inside the room 102 even with varying ambient light conditions (e.g., light applied outside the windows). In certain embodiments, the hue adjusting lighting system compensates for various activities (or user desires) such as photo viewing, mood setting, work, presentations, events, or reading.

In one embodiment, the hue adjusting lighting system 100 as shown in FIG. 1 includes a light source 114, a condenser 116, a lens 118 (e.g., a bi-convex lens), a light hue modulating device 120 that modulates the hue of the light exiting there from, a lens structure 122, a diffuser 124, and a sensor/controller 125. While there is one light hue modulating device 120 shown in FIG. 1, it is to be understood that there can be a large number or array of such devices 120 to provide illumination of the desired hue and intensity. The light source 114 provides the light that is filtered by the hue adjusting lighting system such that the hue of the total light in the room is maintained at the desired hue during normal operations of the hue adjusting lighting system 100. The light source 114 includes, in one embodiment, a white light 130 (such as an incandescent, fluorescent, or mercury vapor light) that is partially surrounded to be encased by a parabolic mirror 132. In other embodiments, the light source 114 does not include a parabolic mirror 132, and a smaller percentage of the light that is applied from the white light 130 is directed to the condenser 116. The white light 130 is typically white to generate any light that can be transmitted from the light hue modulating device 120. The light source generates a considerable number of bandwidths of light, only certain ones of which are displayed by the hue adjusting lighting system 100.

In one embodiment, the parabolic mirror 114 directs the light from the light source 114 to be focused on the condenser 116. The condenser 116 condenses the light, and directs the condensed light at the bi-convex lens 118. The bi-convex lens 118 focuses the condensed light from the light source 114 to the light hue modulating device 120 in a manner that the light hue modulating device 120 receives at least those bandwidths of light that potentially might be used by the hue adjusting lighting system 100. The hues of light (e.g., bandwidths) that are received by the hue adjusting lighting system 100 that are not intended to be directed into the room are filtered out by the light hue modulating device 120. The reflected light emanating from the light hue modulating device 120 is directed towards the lens structure 122 contains those hues that are intended to be applied to the room 102. The lens structure 122 distributes the received light from the light hue modulating device 120 across the diffuser 124 to be applied within the room 102. In one embodiment, the diffuser 124 is configured as a frosted piece of glass that projects light from the light hue modulating device 120 into the room 102.

The sensor/controller 125 includes a light hue detector portion 140 and a controller portion 142. The light hue detector portion 140 detects the hue of the light within the room 102, and may, for example, include a photosensor 141 located in the room (such as are commercially available) that detects the various visible hues of light within the room. In certain embodiments, the controller portion 142 is configured as a computer, a microprocessor, a microprocessor, a microcontroller, etc. that controls the hue of light being produced in response to the current color of the ambient light within the room. The controller portion 142 includes a processor portion 144, a memory 146, and an input/output portion 148. The memory 146 stores data relating to those hues of light that are produced in response to the hues of ambient light detected by the light hue detector portion 140 as is processed by the processor portion 144 to be produced by the light hue modulating device 120. The general operation of computers and controllers are well understood and are commercially available, and will not be further described in this disclosure.

Figure 2:
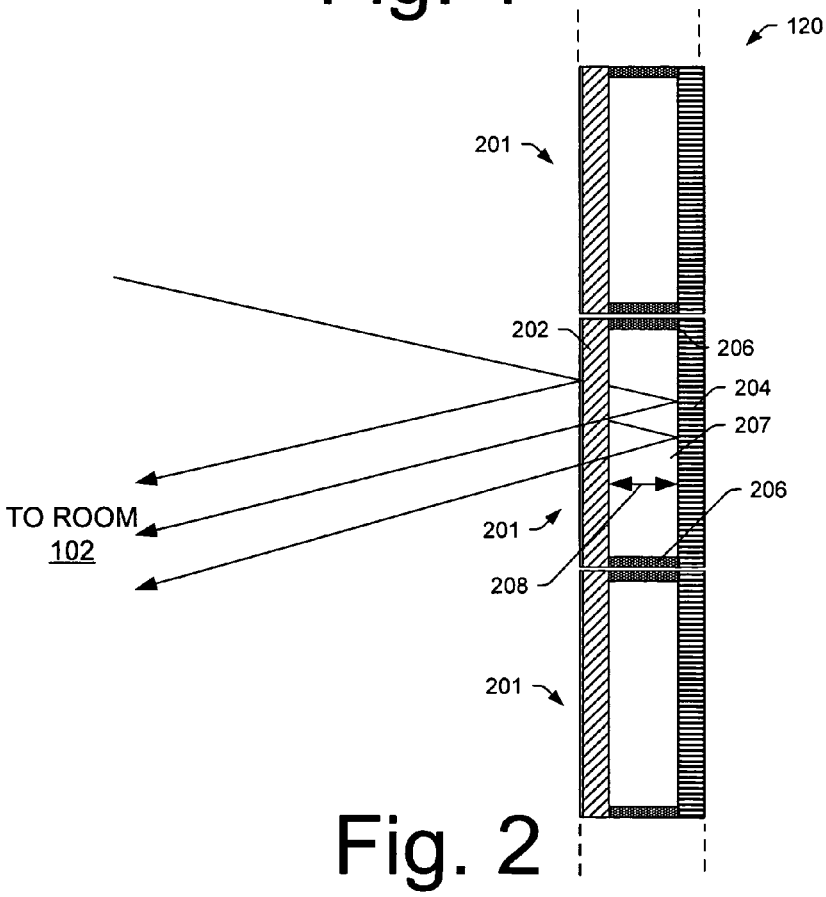
FIG. 2 is a cross-sectional view of one embodiment of a front-lit hue modulating device as shown in the hue adjusting lighting system of FIG. 1.

An expanded view of one embodiment of the light hue modulating device 120 is described with respect to FIG. 2. The light hue modulating device 120 includes at least one chromatic light modulator 201 (three are shown in FIG. 2) that modulates the input light (as received through the bi-convex lens 122 in FIG. 1) to effectively filter out light of undesired bandwidths, whereby only the light of the desired hue(s) is allowed to pass. Fabry-Perot devices, such as are commercially available, can provide filtering in certain embodiment of the light hue modulating device 120. Fabry-Perot devices perform such filtering by reflecting those visible bandwidths of light to constructively interfere with each other that are desired to add to the hue; while those bandwidths of light that destructively interfere with each other are not visible and do not contribute to the hues of light as provided by the light hue modulating device 100. In one embodiment, the light hue modulating device 100 is formed from a single chromatic light modulator 201 whose hue can be modulated to the desired hues. In another embodiment, an array (or other configuration) of a plurality of chromatic light modulators 201 are modulated such that all of the modulators contribute to provide the desired hue.

Figure 6:
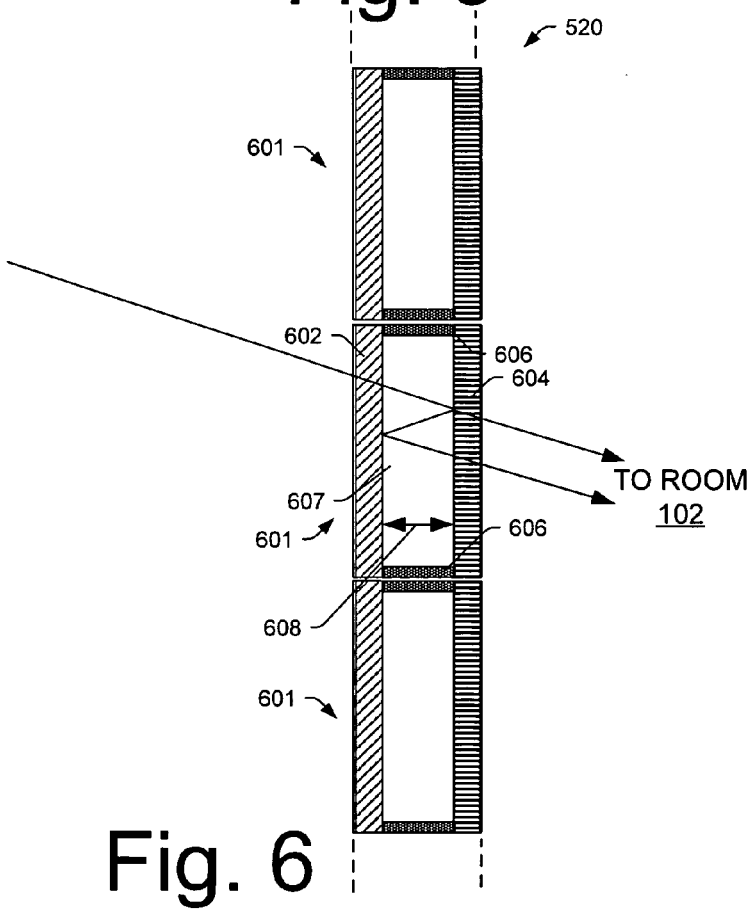
FIG. 6 is a cross-sectional view of one embodiment of a back-lit hue modulating device as shown in the hue adjusting lighting system of FIG. 5.

The embodiment of the light hue modulating device 120 as shown in FIG. 2 is a front-lit device that includes a first reflector 202, a second reflector 204, and a flexure 206 that controls the distance between the first reflector 202 and the second reflector 204. FIG. 6, as described below, provides one embodiment of back-lit light hue modulating device. In one embodiment, front lit light hue modulating devices 120 operate by reflecting the desired bandwidths of light from the chromatic light modulator 201. In one embodiment, the first reflector 202 is formed from a semi-transparent material (e.g., reflects between 10 and 90 percent, such as 50 percent, of the light and reflects the remainder). The light that reflects from the first reflector is directed towards the lens structure 122 as shown in FIG. 2. The light that is transmitted through the first reflector 202 is directed towards the second reflector 204, and is reflected there from towards the first reflector 202. In one embodiment, the second reflector 204 is fully reflective and reflects nearly all of the light directed at it towards the first reflector.

The gap between the first reflector 202 and the second reflector 204 in the light hue modulating device 120 forms a modulator cavity 207. The dimension of a modulator cavity 207 corresponds to the distance of the gap 208 between the reflectors 202, 204. The distance of the gap 208 (and therefore the dimension of the modulator cavity) is adjusted using, for example, a flexure 206 to vary the hue of light that is modulated to constructively interfere from the light hue modulating device. The physics behind constructive interference and destructive interference is generally well known and understood with optical modulators such as conventional Fabry-Perot optical interferometers, and will not be further detailed in this disclosure.

In another embodiment, selected hues of light are directed from the light system 100 to produce some desired optical effect or color to the total light within the room. For instance, it may be desired to project hues of light a particular hue or of a different intensity. In one embodiment, the user selects the hue of the room 102 (or other lighted space) based on the hue provided by the hue adjusting light system 100.

The hue adjusting lighting system 100 takes a broad spectrum of light from the light source which contains those bandwidths of light that are necessary through the day to make the total light a desired hue (e.g., a white light), condenses the light supplied by the light source, passes the light through a Fabry-Perot interferometer, and diffuses the constructively interfering light into the area (e.g., room that is to be lighted. In one embodiment, the sensor/controller 125 of the light hue modulating device 120 is time multiplexed to control the states between the multiple chromatic light modulators 201 that are configured to have their particular gap spacing 208 sizes.

Figure 3:
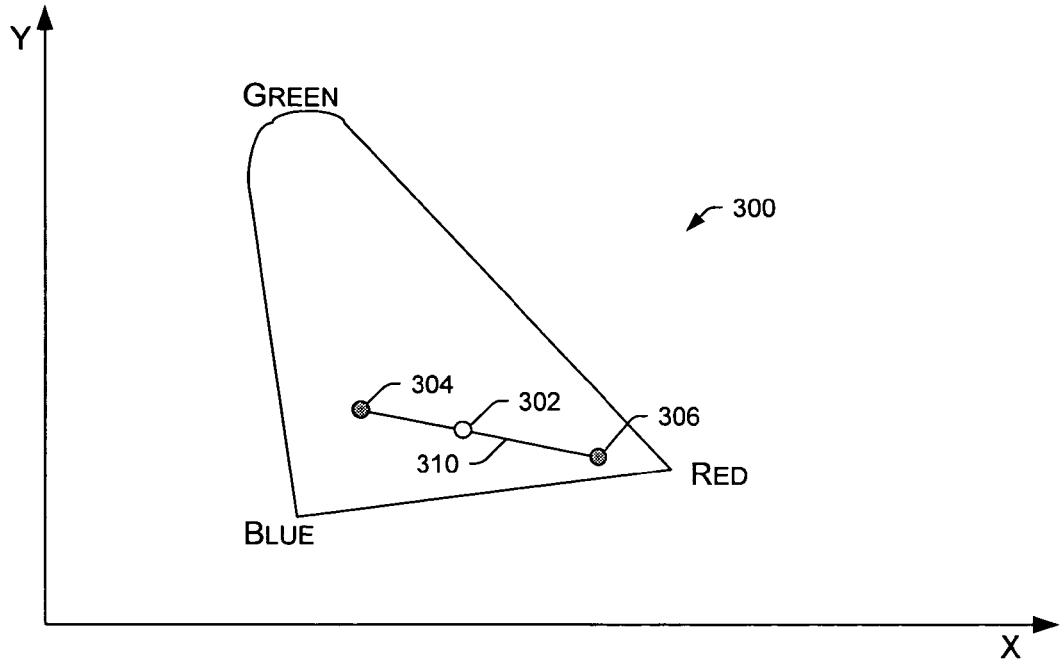
FIG. 3 is one embodiment of a chromaticity diagram that explains part of the operation of the hue adjusting lighting system of FIG. 1.

For example, certain chromatic light modulators may be configured to produce one of the primary or near primary colors (e.g., red, green, or blue). Depending upon the particular hue that is desired to be produced within the room by the hue adjusting light system 100, it is desired to generate different hues from the combination of all of the light hue modulating devices 120 that are contained therein. For example, near sunset in the room 102 as shown in FIGS. 1 and 3, the ambient light source 106 (e.g., the sun) would be generating considerably more red hues of light as shown at 306 in FIG. 3 than during midday as shown as 304. As such, those chromatic light modulators 201 that are generating red light would be either shut down or would be operating to generate light of a lower intensity at sunset; while those chromatic light modulators 201 that are generating blue and green light would be producing increased intensities of light during sunset.

By comparison, during midday, the sun would be generating considerably more blue hues of light and green hues of light than during sunset. As such, those chromatic light modulators 201 that are generating blue light or green light would be either shut down or would be operating to generate light of a lower intensity than during sunset; while those chromatic light modulators 201 that are generating red light would be producing higher intensities of light at midday. In certain embodiments, the user adjusts the controller portion 142 of the sensor controller 125 to set the desired total hue of the light.

As shown in the chromaticity diagram 300 of FIG. 3, a desired room light hue 302 forms a shape that is described according to the three primary colors on the chromaticity diagram: red, green, and blue. A hue line 310 is shown as being drawn from a sunset chromaticity color location 306 to a midday chromaticity color location 304. It may be desired to maintain the desired room light hue 302 on the hue line 310 at some location that corresponds, roughly, to afternoon. For example, the hue adjusting lighting system 100 adjusts the total light at the hue level that is equidistant the sunset chromaticity color location 306 and the midday chromaticity color location 304 along the hue line 310 that corresponds to applying a suitable hue to adjust the overall color of the room. As such, a more consistent hue would be provided within the room throughout the day regardless of the actual time of day and/or the actual ambient light in the room. The adjusting lighting system 100 thereby provides a mechanism to mix a number of colors of the light to thereby create the desired light hue within the room.

In one embodiment, the chromatic light modulators 201 is modulated by having some percentage of the chromatic light modulators project only blue light, only red light, or only green light. As such, all of the chromatic light modulators that project red light, for instance, is turned on to project red light, and is turned off to project no light at a desired frequency and at a desired duration depending upon the intensity and the hue of the light that is desired to be generated. The same on/off states would be allowed for the chromatic light modulators that generate only green light and that generate only blue light.

Figure 4:
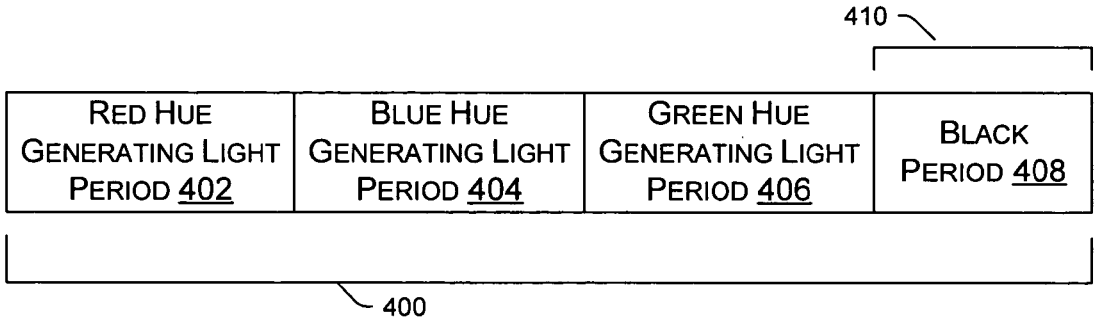
FIG. 4 is one embodiment of a cyclic operation that is used in certain embodiments of the hue adjusting lighting system of FIG. 1.

In another embodiment as shown in FIG. 4, each chromatic light modulator 201 is modulated within a temporally repetitive operation 400 to project light of each of the primary hues for a particular duration. For instance, the chromatic light modulators 201 is modulated to project light through the a red hue generating period 402, the blue generating light period 404, the green generating light period 406, and in one embodiment the black period 408 (in which no light is being generated). To provide such a cyclic operation 400, the gap spacing of the chromatic light modulator 201 as shown in FIG. 2 is varied to the duration that corresponds to each generating light period 402, 404, and 406. In one embodiment, during the black period 408 the chromatic light modulator 201 is turned off to generate no light of any color (which corresponds to generating black light). In another embodiment, during the black period 408 the chromatic light modulator 201 is modulated to generate some invisible color light (e.g., infrared or ultraviolet light) that is not detectable by the human eye.

The cyclic operation of the chromatic light modulator 201 as shown in FIG. 4 is configured to act as a dimmer mechanism 410 for the hue adjusting lighting system 100. The dimmer mechanism 410 acts by adjusting the duration within each cyclic operation period 400 (e.g., the percentage of each cyclic operation period) that the chromatic light modulator 201 is in its black period 208. For instance, if the black light period 408 corresponds to half of the entire cyclic operation period 400, then a fifty percent light intensity would be provided. By comparison, if the black light period 408 corresponds to a quarter of the entire cyclic operation period 400, then a seventy-five percent light intensity would be provided. By adjusting the percentage of time that one of the hue generating time periods 402, 404, and 406 is occurring, the intensity of the light generated at each color is modified, and a dimmer mechanism 410 is thereby provided.

Certain embodiments of a front-lit hue adjusting lighting system 100 are provided with respect to FIG. 1. It is to be understood that the concepts as described in this disclosure are also applicable to back-lit hue adjusting lighting systems 100 as described with respect to FIG. 5. Consider that the in the front lit embodiment of the hue adjusting lighting system 100 as shown in FIG. 1, the light that is directed into the room 102 is reflected from the light hue modulating device 120 (and may thereby be considered as a reflective device). In the back-lit embodiment of the hue adjusting lighting system 100 as shown in FIG. 1, the light that is directed into the room 102 is transmitted through a transmissive light hue modulating device 520 (and may thereby be considered a transmissive device). The other components of the different embodiments of the hue adjusting lighting system 100 acts similarly whether associated with a reflective light hue modulating device 120 or a transmissive light hue modulating device 520.

The embodiment of the light hue modulating device 520 as shown in FIG. 6 is a back-lit device that includes a first reflector 602, a second reflector 604, and a flexure 606 that controls the gap distance 608 between the first reflector 602 and the second reflector 604. In one embodiment, the back-lit light hue modulating devices 520 operate by allowing the desired bandwidths of light to pass through the chromatic light modulator 601. In one embodiment, the first reflector 602 and the second reflector 604 are both formed from a semi-transparent material (e.g., reflects between 10 and 90 percent, such as 50 percent, of the light and transmits the remainder of the light). The light that passes through both reflectors 602 and 604 is directed towards the lens structure 122 as shown in FIG. 5.

The gap between the first reflector 602 and the second reflector 604 in the light hue modulating device 520 forms a modulator cavity 607. The dimension of modulator cavity 607 corresponds to the distance of the gap 608 between the reflectors 602, 604. The distance of the gap 608 (and therefore the dimension of the modulator cavity) is adjusted to vary the hue of light that is modulated to constructively interfere from the light hue modulating device 520. The physics behind constructive interference and destructive interference is generally well known and understood with optical modulators such as conventional Fabry-Perot optical interferometers, and will not be further detailed.

Figure 5:
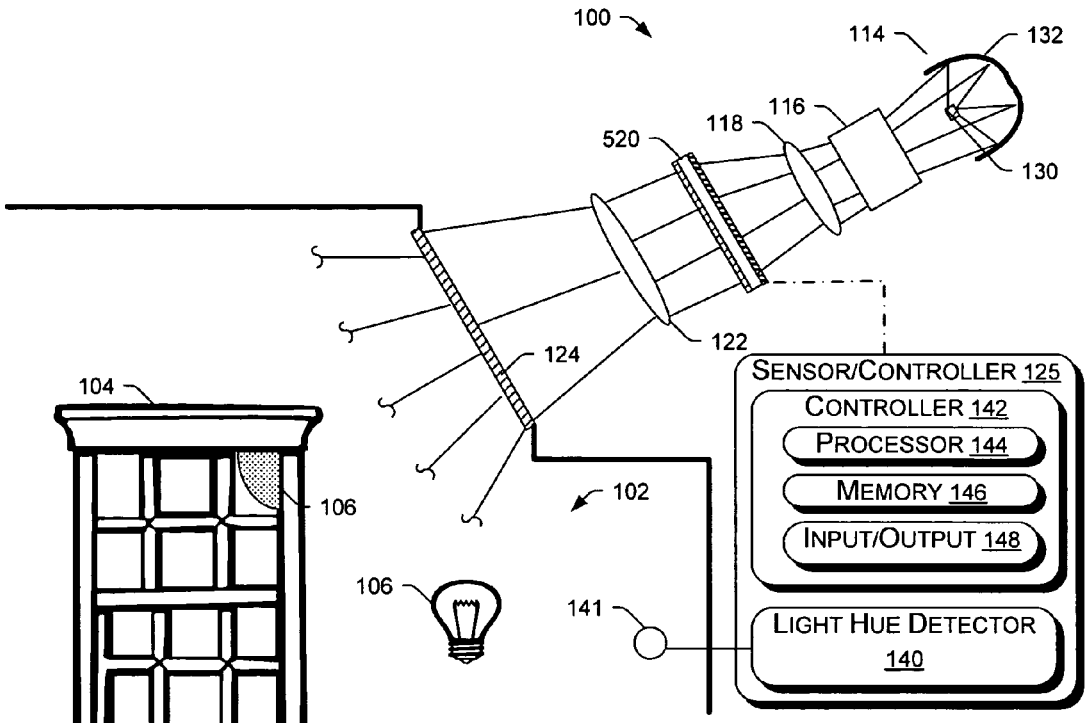
FIG. 5 is a block diagram of another embodiment of a hue adjusting lighting system of the present disclosure that includes a back-lit light hue modulating device.
Figure 7:
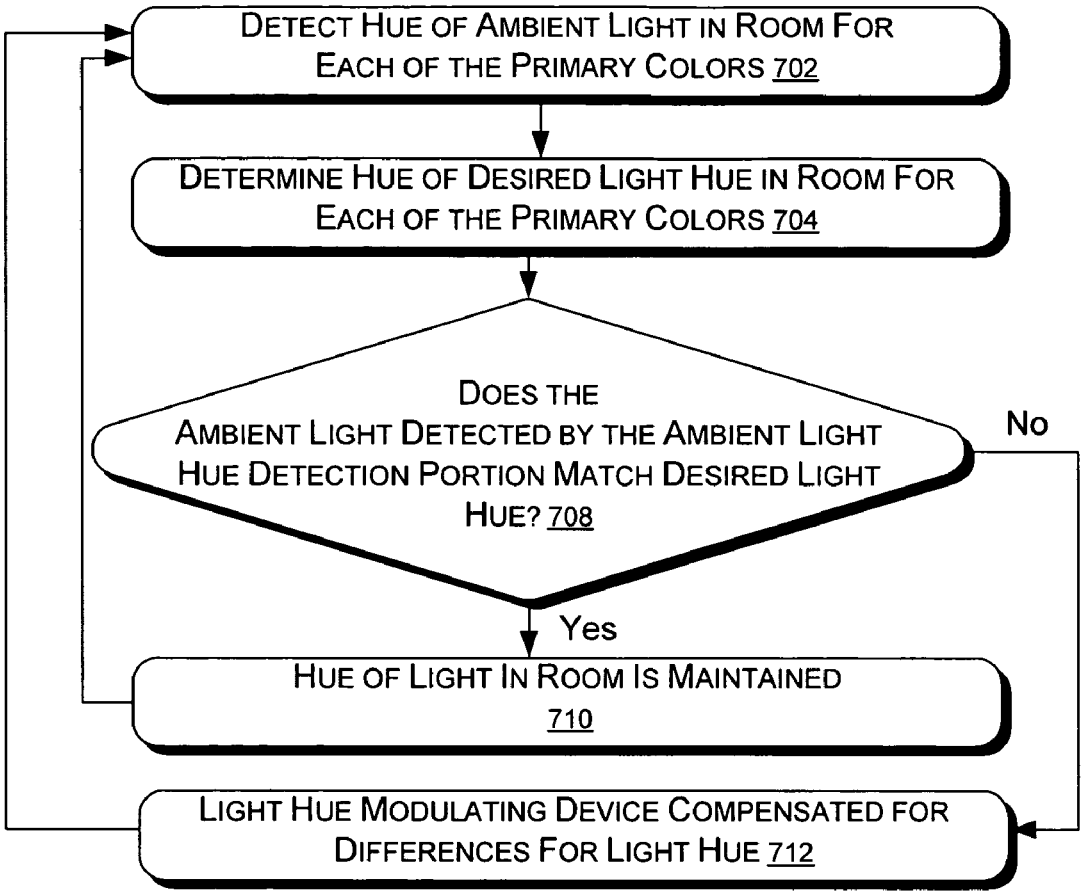
FIG. 7 shows a flow diagram of one embodiment of a compensating hue generation process.

FIG. 7 shows one embodiment of a compensating hue generation process 700 that can be performed by the sensor/controller 125 in combination with the hue adjusting lighting system 100 as shown in FIGS. 1 and 5, or some other hue adjusting lighting system. The compensating hue generation process 700 controls the color of the light generated by the light hue modulating device 520 to compensate for the hue of the ambient light within the room.

The compensating hue generation process 700 includes an ambient light hue detection portion 702 in which the hue of the ambient light within the room is detected. In one embodiment, the ambient light is detected using the photosensor 141 for each of the primary colors. It should be understood that hue color sensors can be used that are similar to the photosensors described with respect to FIG. 1 or 5, or alternately some other hue or color detector can be used to detect the hue of the light.

The compensating hue generation process 700 of FIG. 7 continues to determine the desired hue of the light within the room in portion 704 for each of the primary colors. In one embodiment, the desired hue of the light can be input by the user in the controller 142 portion of the sensor/controller 125 as described with respect to FIGS. 1 and 5. It should be understood that hue color controllers can be used that are similar to the controller 142 described with respect to FIG. 1 or 5, or alternately some other hue or color detector can be used to input a desired hue of light.

The compensating hue generation process 700 continues to decision 708 in which it is determined whether the ambient light detected by the ambient light hue detection portion in the portion 702 matches the desired hue determined in the portion 704 for all of the primary colors. Such matching can be performed in one embodiment using the controller 142 as described with respect to FIGS. 1 and 5, or alternatively some other type of controller can be used. If the answer to 708 is yes, then the hue of light is maintained in the portion 710 for some prescribed duration (after which the compensating hue generation process 700 is repeated by continuing to 702).

If the answer to the decision 708 is no, then the compensating hue generation process 700 continues 712 to compensate the ambient light hue by increasing those hues of light that are below the desired light level, while reducing those hues of sensed light that that are above the desired level for that hue. In one embodiment, this reducing or increasing certain hues of light is accomplished by operating the light hue modulating device (120 as described with respect to FIG. 2 or 520 as described with respect to FIG. 5). It should be understood that other configurations of light hue modulating devices can be used that are within the intended scope of the present disclosure.

The compensation for the ambient light can be configured in a feedback-loop configuration in one embodiment. Applying a certain intensity of a certain color light for one desired color or clue may overly-compensate to a desired color in one small room, fully-compensate in a reasonable sized room, and be ineffective compensation in a huge space. As such, it may be desired to repeat the attempts for compensation multiple times until it is determined the amount of compensation that is necessary.

The desired compensating light portion 712 from the hue adjusting lighting system 100 for those primary colors that do not match. Following the portion 712, the compensating hue generation process 700 continues to 702 as described above.

This disclosure thereby provides a number of embodiments of adjustable hue control mechanisms. Having herein set forth preferred embodiments of the present invention, it is contemplated that suitable modifications can be made thereto which will nonetheless remain within the scope of the present invention.

What is claimed is:

1. A lighting apparatus, comprising:

a sensor that senses hue of an ambient light within a space; and a light hue modulating device that projects a compensating light to adjust the ambient light to a desired hue within the space, wherein the light hue modulating device is a front-lit device.

2. The lighting apparatus of claim 1, further comprising a control device that controls the hue of the compensating light projected by the light hue modulating device in response to the hue of the ambient light.

3. The lighting apparatus of claim 1, further comprising a light source that generates bandwidths of light that are applied by the light hue modulating device to compensate for each level of ambient light that exists in the space.

4. The lighting apparatus of claim 3, wherein the light source produces white light.

5. The lighting apparatus of claim 1, further comprising a condenser lens that condenses the light directed at the light hue modulating device.

6. The lighting apparatus of claim 1, wherein the light hue modulating device is an optical modulator that can modulate the hue of light.

7. The lighting apparatus of claim 1, wherein the ambient light is produced at least partially by the sun.

8. The lighting apparatus of claim 1, wherein the ambient light is produced at least partially by a light source.

9. The lighting apparatus of claim 1, further comprising a sensor/controller mechanism that senses the hue of the ambient light in the space, and thereupon controls the lighting apparatus to generate the desired compensating light.

10. The lighting apparatus of claim 1, wherein the light hue modulating device includes a first reflector, a second reflector, and a flexure that controls the spacing between the first reflector and the second reflector so that light of a desired wavelength constructively interferes.

11. The lighting apparatus of claim 1, wherein the light hue modulating device includes a Fabry-Perot interference device.

12. A lighting system, comprising:

means for controlling and sensing a compensating hue for a compensating light, the compensating hue compensating for a particular ambient light having an ambient hue; and means for modulating the hue of the compensating light into the ambient light to yield a desired total light, wherein the means for modulating the hue includes a plurality of spaced reflectors in which the illumination constructive interferes at the compensating hue.

13. The lighting system of claim 12, wherein the means for modulating the hue includes a front-lit hue modulating device.

14. The lighting system of claim 12, wherein the means for modulating the hue includes a back-lit hue modulating device.

15. The lighting system of claim 12, wherein the means for controlling and sensing a compensating hue includes a feedback loop to compensate for the effectiveness of the means for modulating the hue.

16. A lighting apparatus, comprising:

a sensor that senses hue of an ambient light within a space; and a light hue modulating device that projects a compensating light to adjust the ambient light to a desired hue within the space, wherein the light hue modulating device is a back-lit device.

17. The lighting apparatus of claim 16, further comprising a control device that controls the hue of the compensating light projected by the light hue modulating device in response to the hue of the ambient light.

18. The lighting apparatus of claim 16, further comprising a light source that generates bandwidths of light that are applied by the light hue modulating device to compensate for each level of ambient light that exists in the space.

19. The lighting apparatus of claim 18, wherein the light source produces white light.

20. The lighting apparatus of claim 16, further comprising a condenser lens that condenses the light directed at the light hue modulating device.

21. The lighting apparatus of claim 16, wherein the light hue modulating device is an optical modulator that can modulate the hue of light.

22. The lighting apparatus of claim 16, wherein the ambient light is produced at least partially by the sun.

23. The lighting apparatus of claim 16, wherein the ambient light is produced at least partially by a light source.

24. The lighting apparatus of claim 16, further comprising a sensor/controller mechanism that senses the hue of the ambient light in the space, and thereupon controls the lighting apparatus to generate the desired compensating light.

25. The lighting apparatus of claim 16, wherein the light hue modulating device includes a first reflector, a second reflector, and a flexure that controls the spacing between the first reflector and the second reflector so that light of a desired wavelength constructively interferes.

26. The lighting apparatus of claim 16, wherein the light hue modulating device includes a Fabry-Perot interference device.

27. A lighting apparatus, comprising:

a sensor that senses hue of an ambient light within a space; and a light hue modulating device that projects a compensating light to adjust the ambient light to a desired hue within the space, wherein the light hue modulating device includes a first reflector, a second reflector, and a flexure that controls the spacing between the first reflector and the second reflector so that light of a desired wavelength constructively interferes.

28. A lighting apparatus, comprising;

a sensor that senses hue of an ambient light within a space; and a light hue modulating device that projects a compensating light to adjust the ambient light to a desired hue within the space, wherein the light hue modulating device includes a Fabry-Perot interference device.

* * * * *

UNITED STATES PATENT AND TRADEMARK OFFICE

CERTIFICATE OF CORRECTION

PATENT NO. : 7,213,939 B2
APPLICATION NO. : 10/792259
DATED : May 8, 2007
INVENTOR(S) : Andrew L. Van Brocklin et al.

It is certified that error appears in the above-identified patent and that said Letters Patent is hereby corrected as shown below:

In column 10, line 16, in Claim 28, after “comprising” delete “;” and insert -- : --, therefor.

Signed and Sealed this

Nineteenth Day of May, 2009

John Doll

JOHN DOLL
*Acting Director of the United States Patent and Trademark Office*